US006249941B1

(12) United States Patent
Krupnik et al.

(10) Patent No.: US 6,249,941 B1
(45) **Date of Patent: *Jun. 26, 2001**

(54) NONWOVEN METAL FABRIC AND METHOD OF MAKING SAME

(75) Inventors: Alexander Krupnik, Northbrook; Terrence P. Kane, Morton Grove; Kurt H. Schild, Beach Park, all of IL (US)

(73) Assignee: Rhodes American, Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/606,060

(22) Filed: Feb. 23, 1996

(51) Int. Cl.[7] ..... B21F 45/00
(52) U.S. Cl. ..... 29/4.51; 29/4.52; 29/4.53
(58) Field of Search ..... 29/4.51, 4.52, 29/4.53, 419, 419.1; 51/295, 297; 442/377, 388, 390; 28/108, 107

(56) References Cited

U.S. PATENT DOCUMENTS

| | | |
|---|---|---|
| Re. 28,470 | 7/1975 | Webber . |
| 1,490,544 | 4/1924 | Stern . |
| 3,670,485 | 6/1972 | Brown et al. . |
| 4,022,593 | 5/1977 | Lerner . |
| 4,098,665 | 7/1978 | Frechin . |
| 4,519,201 | 5/1985 | Toon . |
| 4,779,322 | 10/1988 | Dendooven . |
| 4,888,234 | 12/1989 | Smith et al. . |

*Primary Examiner*—I Cuda Rosenbaum
*Assistant Examiner*—Marc Jimenez
(74) *Attorney, Agent, or Firm*—Laff, Whitesel & Saret, LTD.

(57) ABSTRACT

A nonwoven, metal fabric is formed by providing a mass of loose fibers with sufficient lubricating oil for them to be carded without disintegration of the fiber web. The fiber web is then lapped and needled to form a metal fabric of superior strength, density, and thermal insulation properties.

4 Claims, 3 Drawing Sheets

NONWOVEN METAL FABRIC AND METHOD OF MAKING SAME

FIELD

This invention relates to nonwoven metal fabrics, and also to advantageous processing steps for forming such fabrics.

BACKGROUND

It is known to make nonwoven fabrics of polymeric material by, among other steps, separating the polymeric fibers from a bale, either in a dry-laid or wet-laid process, and feeding the fibers into a garnett to be carded, thereby forming a web of nonwoven polymeric fibers. To facilitate formation of the web of polymeric fibers during the carding process, a lubricant may be introduced onto the polymeric fibers. The polymeric fiber web may then be lapped to form multiple layers. During the lapping operation, adjacent layers may be rotated relative to each other by a predetermined angle. The resulting multi-layer polymeric structure can then be needled or needle-punched to interengage fibers of respective layers with each other and thereby form a single fabric of polymeric material. The above-described process steps and the apparatus for accomplishing them are described more fully in "The Non-Woven Fabric Handbook," by The Association of the Non-Woven Fabrics Industry, and in U.S. Pat. No. 4,888,234 to Smith, the teachings of which are incorporated herein by reference.

It is also known to create nonwoven metal fabrics by overlaying portions of a nonwoven, metal web to form a multi-layer structure, and then needling or needle-punching the multi-layer structure to form a coherent metal fabric.

The metal fibers in such structure are formed by shaving a metal member with a serrated blade, the resulting shavings comprising the metal fibers. Although the presence of a lubricant between the metal member and the serrated blade may assist in shaving off metal fibers, a lubricant is not generally used because it remains on the metal fibers of the finished product and interferes with customer acceptance and product function in many applications. As a result, the current art teaches maintaining the metal member and resulting fibers substantially free of any lubricant.

The need to maintain the metal fibers free of lubricant has generally constrained attempts to improve the density, uniformity, strength, heat dissipation, and other characteristics of nonwoven metal fabrics. One attempt at such an improved metal fabric is disclosed in U.S. Pat. No. Re. 28,470 to Webber, but the disclosed porous metal structure and method for making it suffer from additional drawbacks and disadvantages. For example, the process disclosed by Webber for making a metal structure is both far too complex and far too costly for many applications where a nonwoven metal fabric is required. In particular, the metal fibers of Webber are formed by an elaborate process of drawing larger diameter metal wires through various constrictions and by tensioning the resulting fibers until they are less than 50 microns in average diameter. The metal fibers formed by the Webber process have outer surfaces which are not as rough and therefore not as prone to advantageous interengagement as those created by the shaving process discussed above. As a result, Webber requires additional and costly processing steps, such as annealing and compacting, to create a suitably strong, coherent metal structure.

Because the metal fibers resulting from the drawing processes of Webber are smoother than those generated by the shaving process discussed above, and are generally less than 50 microns in average diameter, the fibers of Webber are able to be carded. Unfortunately, however, the Webber process cannot be used for fibers over 50 microns in average diameter, as they generally disintegrate during the process. Thus the Webber process is limited to use with metal fibers under 50 microns in diameter. But such fibers are usually not required by the particular application and, for reasons mentioned above, are too costly for many applications of nonwoven metal fabrics.

As a result, certain textile processing apparatus which might be used to enhance the characteristics of nonwoven metal fabric have not been usable heretofor without disintegration of the constituent metal fibers and a consequent breakdown of any web formed from such fibers.

Accordingly, there is a need for a nonwoven metal fabric which can be economically made using suitably adjusted, current textile processing apparatus.

There is a further need for such metal fabric to have improved uniformity, strength, density, and heat-dissipation characteristics.

SUMMARY

Accordingly, an object of this invention is to provide a nonwoven, metal fabric which has improved characteristics resulting from the way it is processed and manufactured.

According to one aspect of the invention, a nonwoven metal fabric is formed by providing a mass of loose fibers with any suitable lubricant. Some of the fibers are separated from the mass, and the separated fibers are carded on a garnett to form a fiber web. The fiber web is then lapped to form multiple layers of metal fibers, and the multiple layers are then needled in order to interengage the fibers and form the nonwoven metal fabric.

According to another aspect of the invention, the mass of fibers is formed by shaving a metal member with a succession of serrated blades, the fibers having irregular cross-sections and rough outer surfaces. The irregular cross-sections vary along the lengths of the fibers.

In accordance with still another aspect of the invention, the fibers may be either carbon steel, stainless steel, copper, or brass. The fibers have an average, cross-sectional diameter of from about 25 to about 125 microns with a length of one to ten inches.

In accordance with still another aspect of the present invention, the lubricant is an oil, and the fibers have a sufficient amount of oil on their outer surfaces to inhibit substantial disintegration of the web when it is carded.

Still other objects, advantages, and novel aspects of the present invention will become apparent in the detailed description of the invention that follows, which includes the preferred embodiment of the invention and the best mode contemplated for carrying out the invention. This detailed description may be understood by reference to the attached drawings, in which:

DESCRIPTION

Figure 1A:
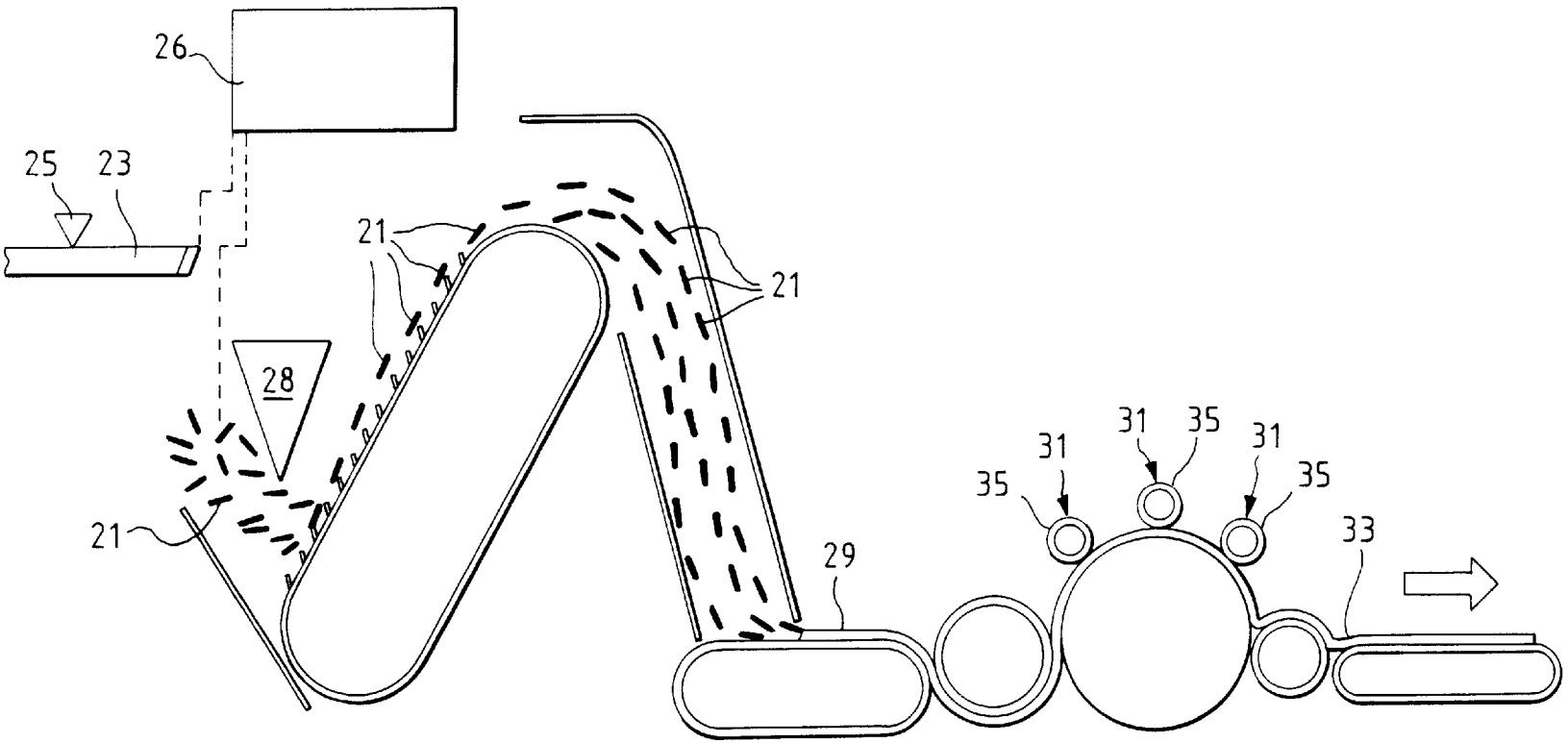
FIGS. 1*a*–1*c* are schematic views showing the formation of the metal fabric according to the present invention.
Figure 1B:
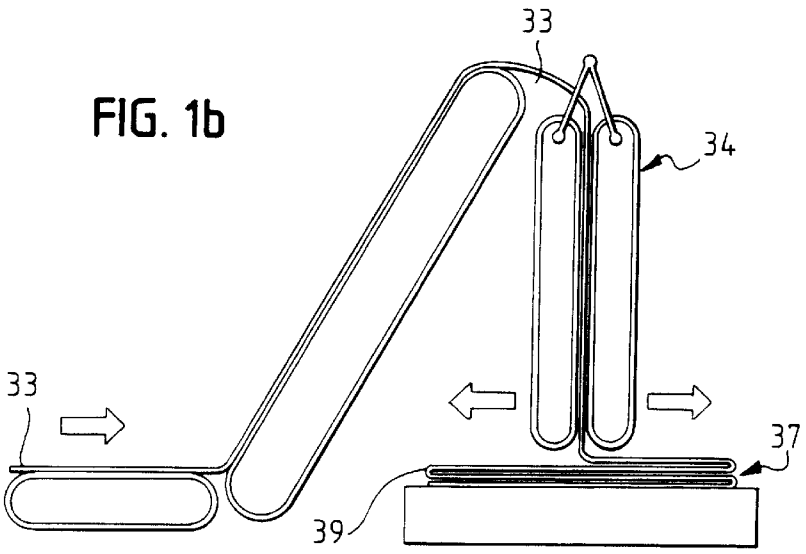
Figure 1C:
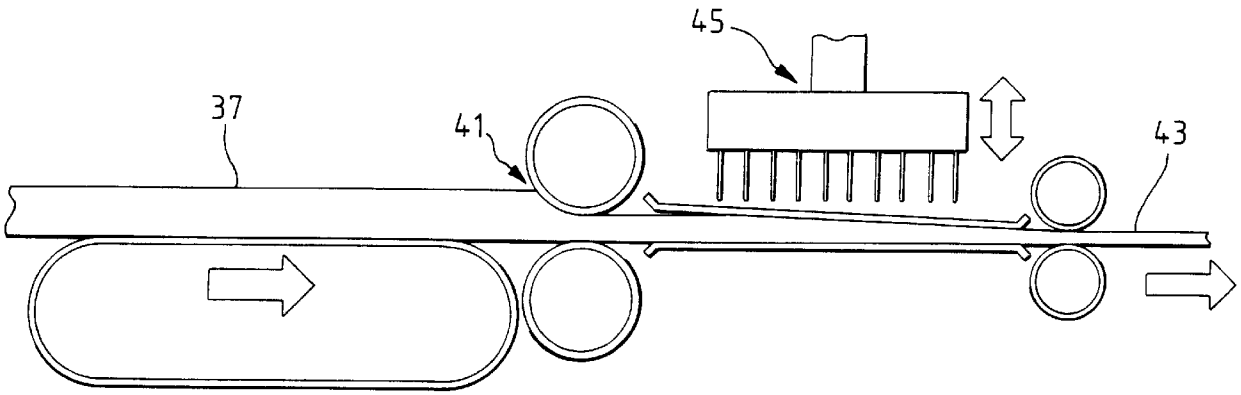

In general terms, a metal fabric is made according to the present invention by providing lubricant to a mass of metal fibers which are cut to a predetermined length of between about 1 to about 10 inches, carding the fibers into a fiber web, and then needling overlying portions of the fiber web to form a coherent metal fabric of improved characteristics.

Referring now to the drawings, and in particular to FIGS. 1*a*–1*c* and 2, a mass or batt of loose fibers 21 is formed by shaving metal member 23 with a succession of serrated blades, of which one is indicated at 25. A suitable lubricant 26, such as oil, is applied to the metal member 23 as it is being acted upon by the blade 25, and the resulting loose fibers 21 retain the oil on their outer surfaces. Alternately, the oil 26 may be applied directly to the mass of loose fibers 21 after they have been shaved from the metal member 23 or during other processing steps which occur prior to carding.

Figure 2:
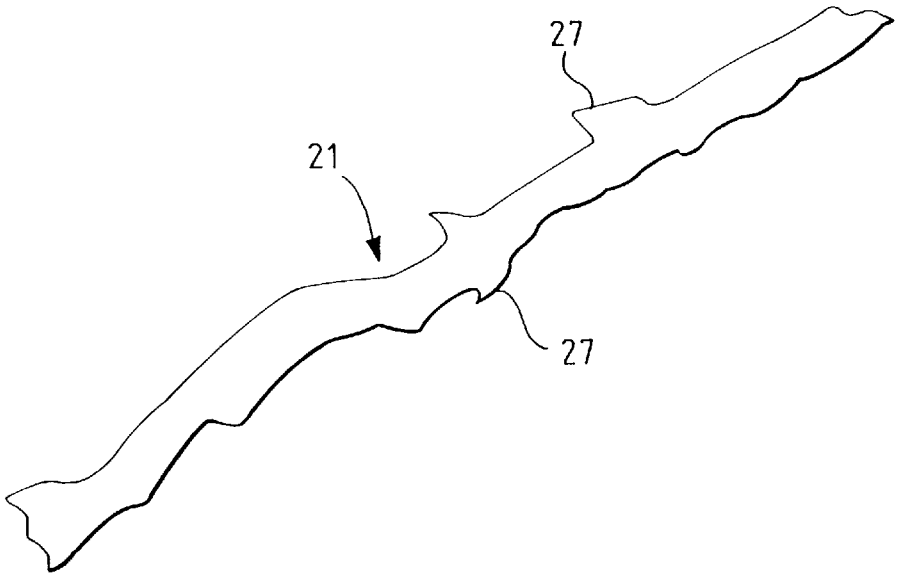
FIG. 2 is an enlarged perspective view of one of the metal fibers of the metal fabric shown in FIG. 1.

By using a succession of serrated blades with a variety of serration patterns thereon, the fibers 21 are provided with irregular cross-sections and rough outer surfaces as indicated in FIG. 2. The irregular cross-sections vary along the length of the fibers 21 produced by the foregoing process, and generally have average cross-sectional diameters of 25 to 125 microns. The variation in cross-sections of the fibers 21 forms barbs 27 in the outer surfaces of the fibers to enhance interengagement. Any of a variety of metals may be used to form the mass of loose fibers, such as carbon steel, stainless steel, copper, and brass.

The mass of loose fibers 21 is cut using suitable metal fiber cutting apparatus 28, such as a rotating knife, to give the fibers 21 a predetermined length ranging between about 1 to about 10 inches. The cut fibers 21 are then fed into conventional textile apparatus which separates the mass of fibers 21 in order to form an embryonic web 29. This process step is sometimes referred to as "web laydown."

The embryonic web 29 is then carded by one or more garnetts 31 to form a fiber web 33. The garnetts 31 may be any suitable apparatus used in the textile field, with the spacing of the cylinders 35 and the garnett wires depending on the size and strength of the metal fibers 21 being acted upon. The carding process generally imparts a slight "machine direction" to the fibers 21, as that term is understood in the textile art.

It is important that sufficient oil or other lubricant be retained on the fibers 21 of the embryonic web 29 so that when the web is processed by the garnetts 31, there is no undesirable fracturing or disintegration of the web 29.

After carding by the garnett 31, the fiber web 33 is lapped by suitable textile apparatus 34 to form a multi-layer structure 37. The lapping apparatus 34 preferably changes the orientation of the fiber web 33 as it is being deposited in successive layers. In this way, the orientation of adjacent ones of the layers 39 are rotated out of alignment from each other by a preselected angle, and the direction of the fibers 21 in the fiber web 33 varies between adjacent layers 39 of the resulting multi-layer structure 37.

Figure 3:
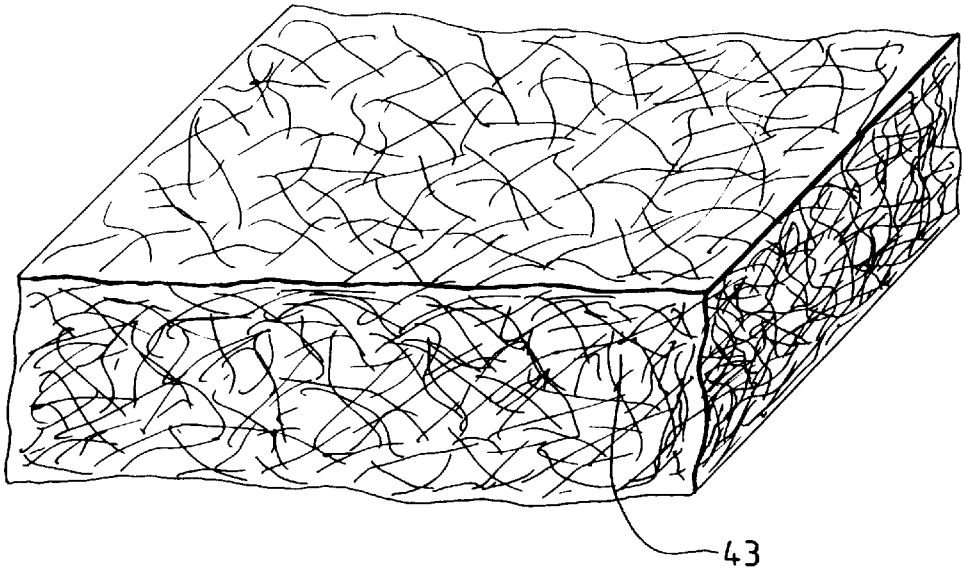
FIG. 3 is a perspective view of the metal fabric after it has been formed.

The multi-layer structure 37 is then fed through a suitable nip 41 and needled or needle-punched by conventional textile apparatus 45 to form a nonwoven metal fabric 43 shown in FIG. 3. The needling of the multiple layers 39 interengages the fibers 21 of respective layers 39, giving the resulting metal fabric 43 improved strength, fiber density, and thermal absorption characteristics for use in any of a variety of applications. The needling process causes the fibers 21 to be interengaged not only within respective layers 39 but also between the layers 39 (in the "z" direction relative to the layers). The resulting fabric 43 thus has the fibers 21 interengaged in the x,y, and z directions to form a suitably strong, coherent metal structure.

The fiber separation, carding, lapping, and needling processes are further described with reference to polymeric fibers in "The Nonwoven Textile Handbook" referred to previously, the teachings of which are incorporated herein by reference.

One suitable set of processing parameters for making the metal fabric 43 is now described. Oil or another suitable lubricant is applied to the metal member 23 at a rate of about 0.5% by weight. The rate varies depending on the metal being processed. A number of suitable apparatuses for carding are available from Proctor & Schwartz, such as their Model No. 600. The gauge of the garnett wires and the settings of the cylinders are selected and adjusted depending on the types of metal fibers being carded. The embryonic web 29 and the fiber web 33 are advanced through the garnetts 31 at a rate which avoids fracturing or disintegration of the fibers 21.

The resulting fiber web 33 is lapped on floor apron 38 in a manner suitable to give the resulting fabric the desired density. For example, in one application, the web 33 is rotated at a rate of 9° to have a reveal of 10% between adjacent ones of the layers 39. A suitable needling apparatus has been found to be Garrett-Bywater Needle Loom or any other similar loom.

A suitable material for the metal member 23 and the metal fibers 21 is carbon steel, such as AISI 1006. Alternately, the fibers 21 may be made out of stainless steel. In the case of stainless steel, oil in the amount of 0.005 ounce per ounce of stainless steel is added to the mass of loose fibers 21. The average diameter of the stainless steel fibers is 50 microns. As a further alternative, the metal may be copper or brass.

The metal fabric 43 formed according to the present invention has superior strength, fiber density, and thermal absorption characteristics. The process for making the metal fabric 43 has the advantage of creating a suitable mass of loose fibers 21 for further processing by shaving a metal member. There is no need to undertake the more complex and costly process of tensioning or drawing a plurality of larger fibers in order to produce the mass of fibers 21.

As a further advantage, the mass of loose fibers 21 may be run through suitably adjusted conventional textile manufacturing apparatus for carding the fibers without the embryonic web disintegrating, weakening, or otherwise losing its required structural integrity. The carding of the steel wool fibers has the advantageous and unexpected result of increasing fiber density, strength, and thermal absorption properties without a corresponding increase in processing complexity or cost.

While the present invention has been described with reference to preferred embodiments thereof, as illustrated in the accompanying drawings, various changes and modifications can be made by those skilled in the art without departing from the spirit and scope of the present invention; therefore, the appended claims are to be construed to cover equivalent structures.

What is claimed is:

1. A method of making a nonwoven metal fabric, comprising the steps of:

shaving a metal member with a succession of serrated blades while simultaneously adding a lubricant to form a mass of loose shavings in the form of metal fibers having rough outer surfaces and cross-sections which vary irregularly along their lengths to form barbs which facilitate subsequent mutual interengagement of said fibers, said serrated blades being selected so that the average diameter of said fibers is at least 50 microns, said lubricant being supplied in sufficient quantity such that the rough outer surfaces of the fibers remain coated with lubricant, thereby allowing said 50 micron average diameter fibers to be carded without undue fracturing;

then separating said fibers from the mass;

then carding said fibers to form a fiber web;

then lapping said fiber web to form multiple layers;

and then needling the multiple layers together to interengage said fibers thereof to form a nonwoven metal fabric.

2. The method of claim 1 wherein said lubricant is added to the mass of loose shavings at a rate of about 0.5% by weight.

3. The method of claim 1 wherein said metal member comprises stainless steel.

4. The method of claim 3 wherein said lubricant comprises oil added to the fiber mass in an amount equal to 0.005 ounce per ounce of stainless steel.

* * * * *